US009190758B2

(12) United States Patent
Endo et al.

(10) Patent No.: US 9,190,758 B2
(45) Date of Patent: Nov. 17, 2015

(54) CONNECTOR TERMINAL

(71) Applicant: DAI-ICHI SEIKO CO., LTD., Kyoto (JP)

(72) Inventors: Takayoshi Endo, Shizuoka (JP); Sakai Yagi, Shizuoka (JP); Takuya Takeda, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/602,029

(22) Filed: Jan. 21, 2015

(65) Prior Publication Data

US 2015/0222040 A1 Aug. 6, 2015

(30) Foreign Application Priority Data

Feb. 6, 2014 (JP) ..... 2014-021522

(51) Int. Cl.

| | |
|---|---|
| ***H01R 13/187*** | (2006.01) |
| ***H01R 13/424*** | (2006.01) |
| ***H01R 13/629*** | (2006.01) |
| ***H01R 24/76*** | (2011.01) |

(52) U.S. Cl.

CPC ..... *H01R 13/424* (2013.01); *H01R 13/187* (2013.01); *H01R 13/629* (2013.01); *H01R 24/76* (2013.01)

(58) Field of Classification Search

USPC ..... 439/842, 843, 845, 851–853

See application file for complete search history.

(56) References Cited

U.S. PATENT DOCUMENTS

| | | | | |
|---|---|---|---|---|
| 6,139,376 | A * | 10/2000 | Ooya | H01R 13/187 439/843 |
| 8,038,488 | B2 * | 10/2011 | Mukuno | H01R 4/4881 439/845 |
| 8,128,441 | B2 * | 3/2012 | Mukuno | H01R 13/055 439/845 |
| 2001/0024912 | A1 | 9/2001 | Sato et al. | 439/843 |
| 2003/0096540 | A1 | 5/2003 | Smyk | 439/843 |
| 2013/0260599 | A1 | 10/2013 | Chikusa et al. | 439/357 |

FOREIGN PATENT DOCUMENTS

| | | | |
|---|---|---|---|
| JP | S59-3877 | 1/1984 | H01R 13/11 |
| JP | H04-008623 | 3/1992 | H01R 13/187 |
| JP | H05-258832 | 10/1993 | H01R 43/16 |
| JP | 2001-52791 | 2/2001 | H01R 13/114 |
| JP | 2003-187893 | 7/2003 | H01R 13/187 |
| JP | 2003-331962 | 11/2003 | H01R 13/05 |
| JP | 2007-59096 | 3/2007 | H01R 13/11 |
| JP | 2011-119108 | 6/2011 | H01R 13/11 |
| JP | 2011-253717 | 12/2011 | H01R 13/42 |
| JP | 2013-206667 | 10/2013 | H01R 13/42 |

* cited by examiner

*Primary Examiner* — Tho D Ta

(74) *Attorney, Agent, or Firm* — Hayes Soloway P.C.

(57) ABSTRACT

A connector terminal includes a hollow sheath portion to be inserted into a terminal space formed in a housing of an electric connector, and an elastic contact piece positioned in the sheath portion, the contact piece making mechanical and electrical contact with a male terminal of an opponent electric terminal when the male terminal is inserted into the sheath portion, the male terminal being inserted into the sheath portion through an insertion path formed in the housing, the sheath portion being formed with a projection on at least one of inner walls thereof facing each other, the projection introducing a distal end of the contact piece to be located out of a cross-section of the insertion path in a direction perpendicular to a direction in which the male terminal is inserted into the sheath portion.

7 Claims, 16 Drawing Sheets

CONNECTOR TERMINAL

BACKGROUND OF THE INVENTION

1. Field of the Invention

The invention relates to a connector terminal including a hollow sheath portion to be inserted into a terminal space formed in a housing of an electric connector, and an elastic contact piece positioned in the sheath portion to make mechanical and electrical contact with a male terminal of an opponent electric terminal when the male terminal is inserted into the sheath portion.

2. Description of the Related Art

There is known a female connector terminal to be inserted into a terminal space formed in a connector housing to make mechanical and electrical contact with a male terminal of an opponent connector when the male terminal is inserted into the terminal space.

FIG. 15 is a perspective view of an example of such a female connector terminal, suggested in Japanese Patent Application Publication No. 2001-52791.

A female terminal 1000 illustrated in FIG. 15 includes a sheath portion 1001 and an elastic contact plate 1005 housed in the sheath portion 1001. The sheath portion 1001 is formed at a front edge 1003 aligning with an opening edge 1002 thereof with a stepped portion 1004. The elastic contact plate 1005 is formed at a front edge thereof with an engagement portion 1006 to be engaged with the stepped portion 1004.

In the female terminal 1000 illustrated in FIG. 15, when a male terminal (not illustrated) is inserted into the sheath portion 1001 through the opening thereof, the elastic contact plate 1005 does not move in a direction in which the male terminal is inserted into the sheath portion 1001, and hence, ear pieces 1007 formed at the elastic contact plate 1005 do not make intensive abutment with peripheral inner edges of windows 1009 formed at sidewalls 1008 of the sheath portion 1001. Thus, the elastic reaction of the elastic contact plate 1005 is not interfered with the male terminal in the female terminal 1000, and accordingly, it is not necessary to insert the male terminal into the sheath portion 1001 with an intensive force.

FIG. 16 is a perspective view of another example of the above-mentioned female connector terminal, suggested in Japanese Utility Model Publication H4 (1992)-8623.

A female terminal 1100 illustrated in FIG. 16 includes a sheath portion 1101 to receive a male terminal (not illustrated) therein, and an elongate flat spring 1102 housed in the sheath portion 1101. The flat spring 1102 is formed at opposite side edges thereof with outwardly projecting ear pieces 1103. By causing the ear pieces 1103 to be engaged to grooves 1104 formed at sidewalls of the sheath portion 1104, the flat spring 1102 is fixed in the sheath portion 1101.

The sheath portion 1101 is formed at sidewalls thereof with stepped portions 1105 in alignment with lower edges of the grooves 1104. Accordingly, the stepped portions 1105 support the ear pieces 1103 of the flat spring 1102, and the ear pieces 1103 are further supported on the lower edges of the grooves 1104 to thereby be located in a designed position.

The female terminal 1000 illustrated in FIG. 15 is accompanied with a problem that since the engagement portion 1006 formed at a front edge of the elastic contact plate 1005 is engaged only to the stepped portion 1004, the elastic contact plate 1005 may float up at the front edge thereof from a desired position.

If the male terminal is inserted into the sheath portion 1101 while the elastic contact plate 1005 is floating up at the front edge thereof, the male terminal makes contact with and pushes the front edge, resulting in that it is afraid that the elastic contact plate 1005 may be bent or damaged by the male terminal.

In the female terminal 1100 illustrated in FIG. 16, since the stepped portions 1105 are formed in alignment with the lower edges of the grooves 1104, the flat spring 1102 may be displaced at a front edge thereof to a level of the grooves 1104. Thus, if the flat spring 1102 is displaced at a front edge thereof to a level of the grooves 1104, the male terminal inserted into the sheath portion 1101 makes contact with and pushes the front edge of the flat spring 1102, resulting in that it is afraid that the flat spring 1102 may be bent or damaged by the male terminal.

As mentioned above, the conventional female terminals 1000 and 1100 are accompanied with a problem that when the male terminal is inserted into the sheath portion 1001 or 1101, it is possible that the male terminal may bend or damage the contact plate 1005 or the flat spring 1102 with the result of failure in electrical contact between the female and male terminals.

SUMMARY OF THE INVENTION

In view of the above-mentioned problems in the conventional female terminals, it is an object of the present invention to provide a connector terminal capable of surely allowing a male terminal to make contact with an elastic contact plate of a female terminal to thereby provide highly reliable contact between male and female terminals.

In one aspect of the present invention, there is provided a connector terminal including a hollow sheath portion to be inserted into a terminal space formed in a housing of an electric connector, and an elastic contact piece positioned in the sheath portion, the contact piece making mechanical and electrical contact with a male terminal of an opponent electric connector when the male terminal is inserted into the sheath portion, the male terminal being inserted into the sheath portion through an insertion path formed in the housing, the sheath portion being formed with a projection on at least one of inner walls thereof facing each other, the projection introducing a distal end of the contact piece to be located out of a cross-section of the insertion path in a direction perpendicular to a direction in which the male terminal is inserted into the sheath portion.

In accordance with the above-mentioned connector terminal, the projection introduces a distal end of the contact piece to be located out of a cross-section of the insertion path. That is, even if the elastic contact piece attempts to float up at its distal end to thereby be located within a cross-section of the insertion path, the projection makes abutment with the distal end of the elastic contact piece to prevent the elastic contact piece from displacing. Thus, it is possible to prevent the distal end of the elastic contact piece from interfering with the male terminal.

For instance, the projection may be formed by forming a recess on an outer surface of a sidewall of the sheath portion.

The projection may be formed on sidewalls of the sheath portion merely by pressing a metal sheet without necessity of newly forming a part on the sidewalls as the projection.

It is preferable that the projection is formed on both of the inner walls of the sheath portion.

By forming the projections on both of the inner walls of the sheath portion, the distal end of the elastic contact piece can make uniform contact at side edges thereof with the projections, ensuring it to prevent the elastic contact piece from displacing or floating up. That is, a pair of the projections prevents the elastic contact piece from displacing only at one of side edges.

It is preferable that the contact piece is formed with a raised portion at which the contact piece makes contact with the male terminal, a distance between the projection and a summit of the raised portion being smaller than a width of the male terminal.

Even if a male terminal is inserted into the sheath portion such that a longitudinal axis of the male terminal is out of a center of the sheath portion and is deviated towards one of sidewalls of the sheath portion, the projection allows the male terminal and the raised portion to make stable contact with each other.

It is preferable that a distance between the projections is smaller than a width of an opening through which a jig is inserted into the housing for releasing the sheath portion having been engaged to an engagement portion in the terminal space.

It is preferable that a distance between the projection and the inner wall facing the projection is smaller than a width of an opening through which a jig is inserted into the housing for releasing the sheath portion having been engaged to an engagement portion in the terminal space.

Even if a user attempts to insert a jig into not the opening, but the sheath portion, an inner space of the sheath portion is narrowed by the projection, and accordingly, it is possible to prevent the user from inserting a jig wrongly into the sheath portion.

It is preferable that the sheath portion has an opening greater in four directions than the insertion path when the connector terminal is inserted into the housing.

The advantages obtained by the aforementioned present invention will be described hereinbelow.

In accordance with the above-mentioned connector terminal, the projection makes contact with a distal end of the elastic contact piece to thereby prevent the elastic contact piece from displacing into an area corresponding to the insertion path. Accordingly, the elastic contact piece does not interfere at a distal end thereof with a male terminal having been inserted into the sheath portion. Thus, the male terminal is able to surely make mechanical and electrical contact with the elastic contact piece to thereby provide highly reliable electrical connection between the male terminal and the connector terminal.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 1:
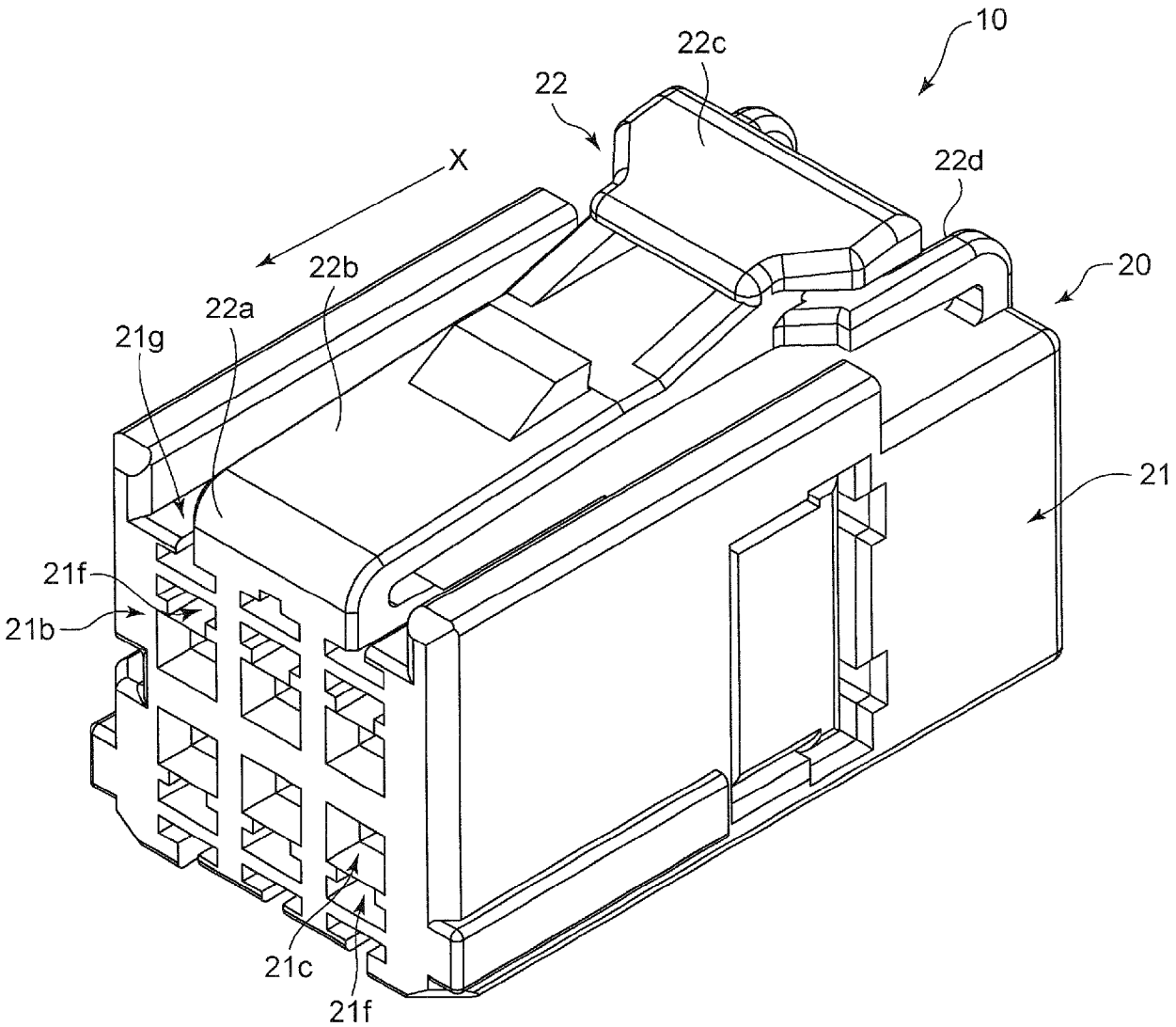
FIG. 1 is a perspective view of an electric connector into which the connector terminal in accordance with the embodiment of the present invention is inserted.

A connector terminal in accordance with the preferred embodiment of the present invention and an electric connector employing the connector terminal are explained hereinbelow with reference to drawings. In the specification, a wording "front" or "forward" refers to a direction in which the connector terminal is inserted into a housing (that is, a direction X illustrated in FIG. 1), and a wording "rear" or "backward" refers to the opposite direction.

An electric connector 10 illustrated in FIGS. 1 to 4 is a female connector into which a male connector C (see FIG. 11) including male terminals P each in the form of a needle is inserted.

The electric connector 10 includes a housing 20 formed by a molding injection process, and a plurality of female connector terminals 30 in accordance with the preferred embodiment of the present invention. Each of the male terminals P of the male connector C is inserted into the corresponding connector terminal 30 to thereby make electrical contact with the connector terminal 30.

The housing 20 includes a housing body 21, and a locker arm 22.

The housing body 21 is in the form of a rectangular parallelepiped, and is formed with totally six terminal spaces 21*a* (see FIG. 4) arranged by horizontally three rows and vertically two rows. The terminal spaces 21*a* extend in the direction X (see FIG. 1).

Figure 3:
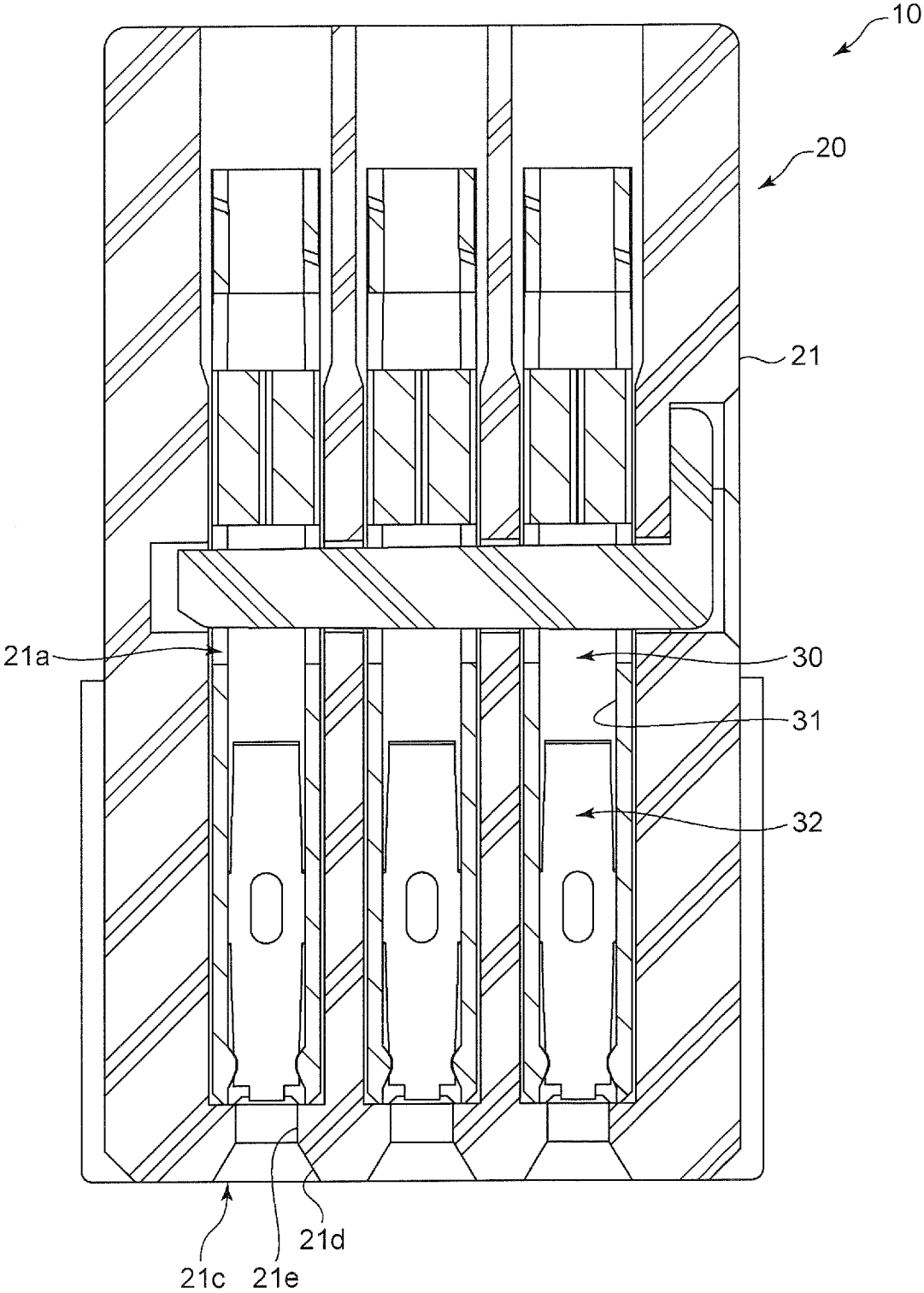
FIG. 3 is a cross-sectional view taken along the line III-III shown in FIG. 2.
Figure 4:
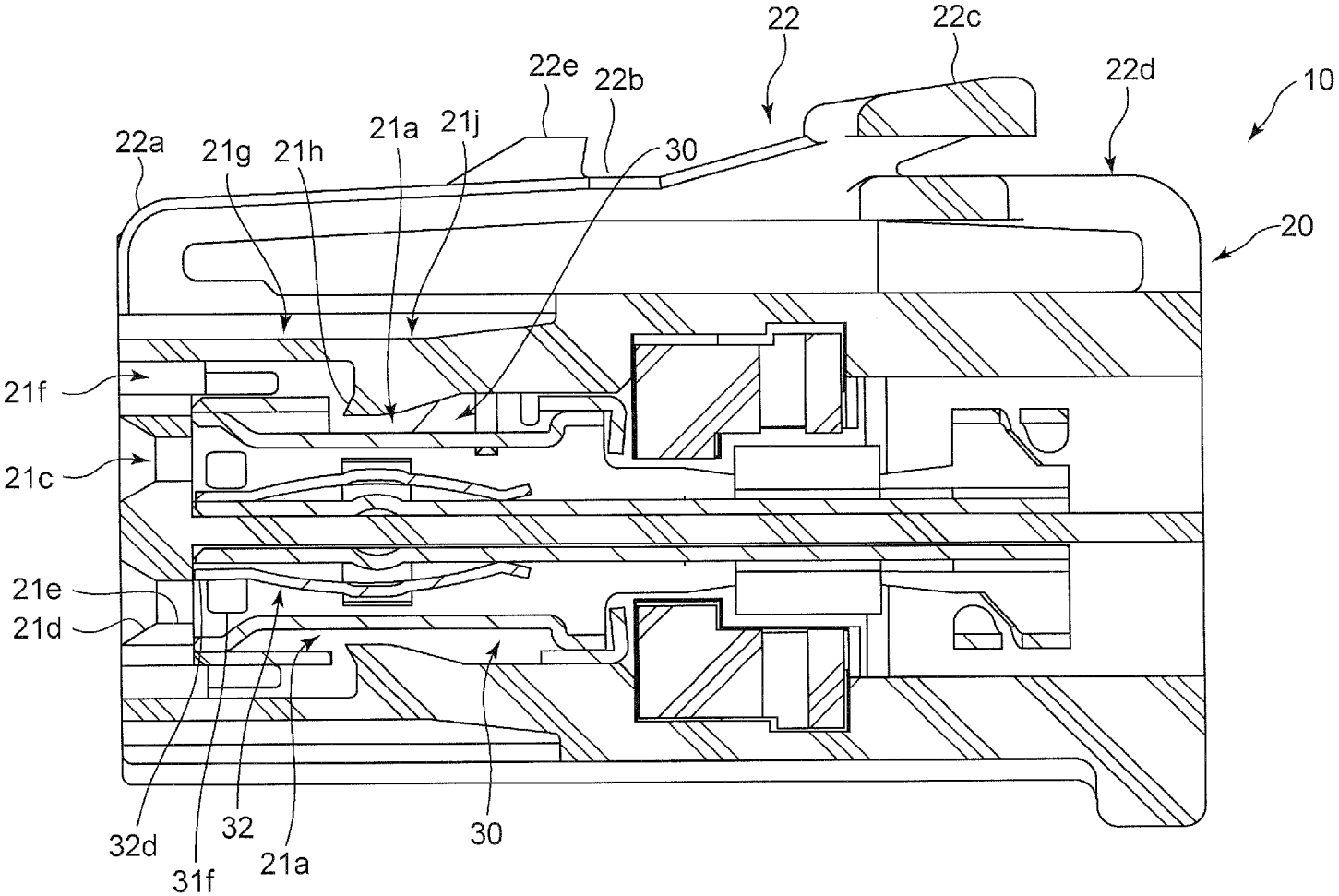
FIG. 4 is a cross-sectional view taken along the line IV-IV shown in FIG. 2.

The housing body 21 is formed at a front 21*b* thereof with a plurality of insertion openings 21*c* through each of which the male terminal P is inserted into the housing body 21. As illustrated in FIGS. 3 and 4, each of the insertion openings 21*c* includes a guide portion 21*d* having a rectangular cross-section and having a smaller inner width at a location closer to the terminal space 21*a* for the purpose of causing the male terminal P to direct towards a central axis of the insertion opening 21*c*, and a path 21*e* having an inner width equal to the smallest inner width of the guide portion 21*d*, and connecting therethrough the guide portion 21*d* and the terminal space 21*a* to each other.

Figure 2:
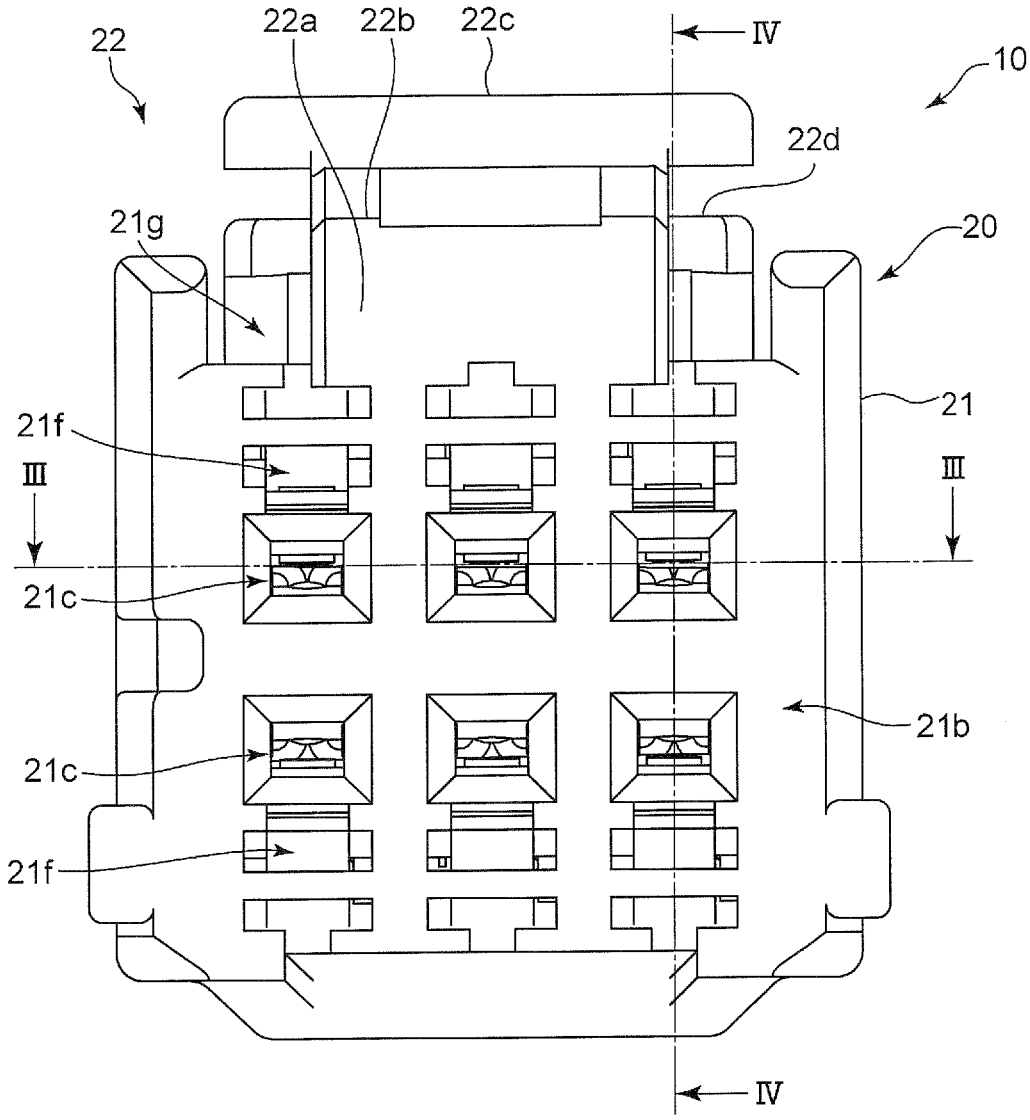
FIG. 2 is a front view of the electric connector illustrated in FIG. 1.

As illustrated in FIGS. 1, 2 and 4, the housing body 21 is formed at the front 21*b* thereof with jig-insertion openings 21*f* through each of which a jig is inserted into the housing body 21 for the purpose of releasing the connector terminal 30 out of the housing body 21.

As illustrated in FIG. 4, the housing body 21 is formed at an inner ceiling 21*g* with a stopper 21*j* including a lance portion 21*h*. The lance portion 21*h* is engaged to the connector terminal 30 having been inserted into the terminal space 21*a* through a rear of the housing body 21, to thereby prevent the connector terminal 30 from being released out of the housing body 21.

The locker arm 22 includes a front end connected to the housing body 21, an arm body 22*b* supported by the front end 22*a*, a releaser 22*c* used for unlocking the connector terminal 30 from the housing body 21, and a rear end connected to the housing body 21 and located beneath the releaser 22*c*.

The front end 22*a* is elastically deformed when the releaser 22*c* is pushed down. The arm body 22*b* includes a claw 22*e* to be engaged to a housing H of the male connector C to thereby lock the housing H to the housing body 20. The releaser 22*c* is formed on the arm body 22*b* at a location between the front end 22*a* and the rear end 22*d*, and extends obliquely and upwardly towards the rear end 22*d*.

When the releaser 22*c* is pushed down, the arm body 22*b* is downwardly deformed with both the front end 22*a* and the rear end 22*d* acting as fulcrums, and makes abutment with the rear end 22*d*. Then, the arm body 22*b* is deformed wherein an area at which the front end 22*a* and the releaser 22*c* make abutment with the rear end 22*d* acts as a fulcrum. Thus, the housing 20 is unlocked from the housing H of the male connector C.

Hereinbelow is explained the connector terminal 30 with reference to the drawings.

As illustrated in FIGS. 5 to 8, the connector terminal 30 includes an electrically conductive hollow sheath portion 31 to be inserted into the housing 20, an elastic contact piece 32 positioned in the sheath portion 31 in such a condition that the contact piece 32 is electrically connected with the sheath portion 31, and a bundle portion 33 extending backwardly from the sheath portion 31.

A cable (not illustrated) is compressed into and fixed in the bundle portion 33.

The sheath portion 31, the elastic contact piece 32 and the bundle portion 33 are integrally formed with one another by bending an electrically conductive metal sheet. As an alternative, the elastic contact piece 32 may be formed as a separate part from the sheath portion 31.

The sheath portion 31 is formed by punching a metal sheet into a desired shape, and bending a floor 31*a*, sidewalls 31*b* and 31*c* and a ceiling 31*d* into a quadratic prism.

The sheath portion 31 is formed at the sidewall 31*b* with an uprightly standing stabilizer 31*e* in order to prevent the connector terminal 30 from being inserted into the housing 20 upside down, and further, to stabilize a position of the connector terminal 30 relative to the housing 20 after the connector terminal 30 has been inserted into the housing 20.

The sheath portion 31 is formed at inner walls 31*b*A and 31*c*A of the sidewalls 31*b* and 31*c* thereof with projections 31*f*. As mentioned later in detail, the projections 31*f* introduce a distal end of the contact piece 32 to be located out of a cross-section of the insertion opening 21*c*. For instance, the projections 31*f* can be formed by forming recesses 31*g* on an outer surface of the sidewalls 31*b* and 31*c* of the sheath portion 31.

The sheath portion 31 is formed at the sidewalls 31*b* and 31*c* thereof with cut-outs 31*h* into which ears 32*b* of the elastic contact piece 32 are fit.

The elastic contact piece 32 is formed of an arcuate flat spring on the floor 31*a* in a longitudinal direction of the sheath portion 31. The elastic contact piece 32 includes a flat spring 32*a* bending in an arcuate form, ears 32*b* extending perpendicularly from side edges of the flat spring 32*a* at a longitudinal center of the flat spring 32*a*, and a raised portion 32*c* formed on the flat spring 32*a* between the ears 32*b*. The raised portion 32*c* makes contact with the male terminal P.

Figure 8:
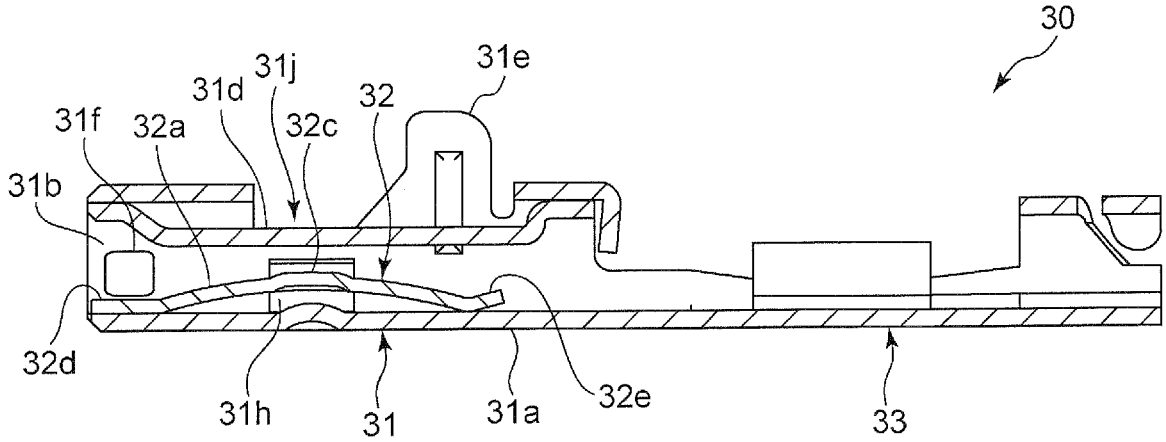
FIG. 8 is a cross-sectional view taken along the line VIII-VIII shown in FIG. 6.

As illustrated in FIG. 8, the elastic contact piece 32 is supported on the floor 31*a* of the sheath portion 31 at front and rear ends 32*d* and 32*e* thereof, and the ears 32*b* located at a longitudinal center of the elastic contact piece 32 are fit into the cut-outs 31*h* formed at the sidewalls 31*b* and 31*c* of the sheath portion 31, preventing the elastic contact piece 32 from displacing towards the ceiling 31*d*. Thus, even if the front and rear ends 32*d* and 32*e* act as free ends, the elastic contact piece 32 can act as an arcuate flat spring.

The raised portion 32*c* is hemisphere (see FIG. 6), and can be formed on an upper surface of the flat spring 32*a* by forming a recess on a lower surface of the flat spring 32*a*.

The connector terminal 30 is formed as follows.

First, a metal sheet in which the projections 31*f* have been already formed is punched into a desired outline including the sheath portion 31 in a developed condition. The cut-outs 31*f* are formed when the metal sheet is punched into the desired outline.

Then, the elastic contact piece 32 is positioned on the floor 31*a* of the sheath portion 31.

Then, the sidewalls 31*b* and 31*c* are caused to stand up relative to the floor 31*a* such that the ears 32*b* of the elastic contact piece 32 are fit into the cut-outs 31*h*.

Then, the sidewall 31*c* is bent to thereby form the ceiling 31*d* above the floor 31*a*, and a remainder except a portion which will be a recess 31*j* to which the lance portion 21*h* (see FIG. 4) is engaged is bent towards the ceiling 31*d*.

Thus, there is completed the connector terminal 30.

The connector terminal 30 having the above-mentioned structure, in accordance with the preferred embodiment, is used as follows.

Figure 9:
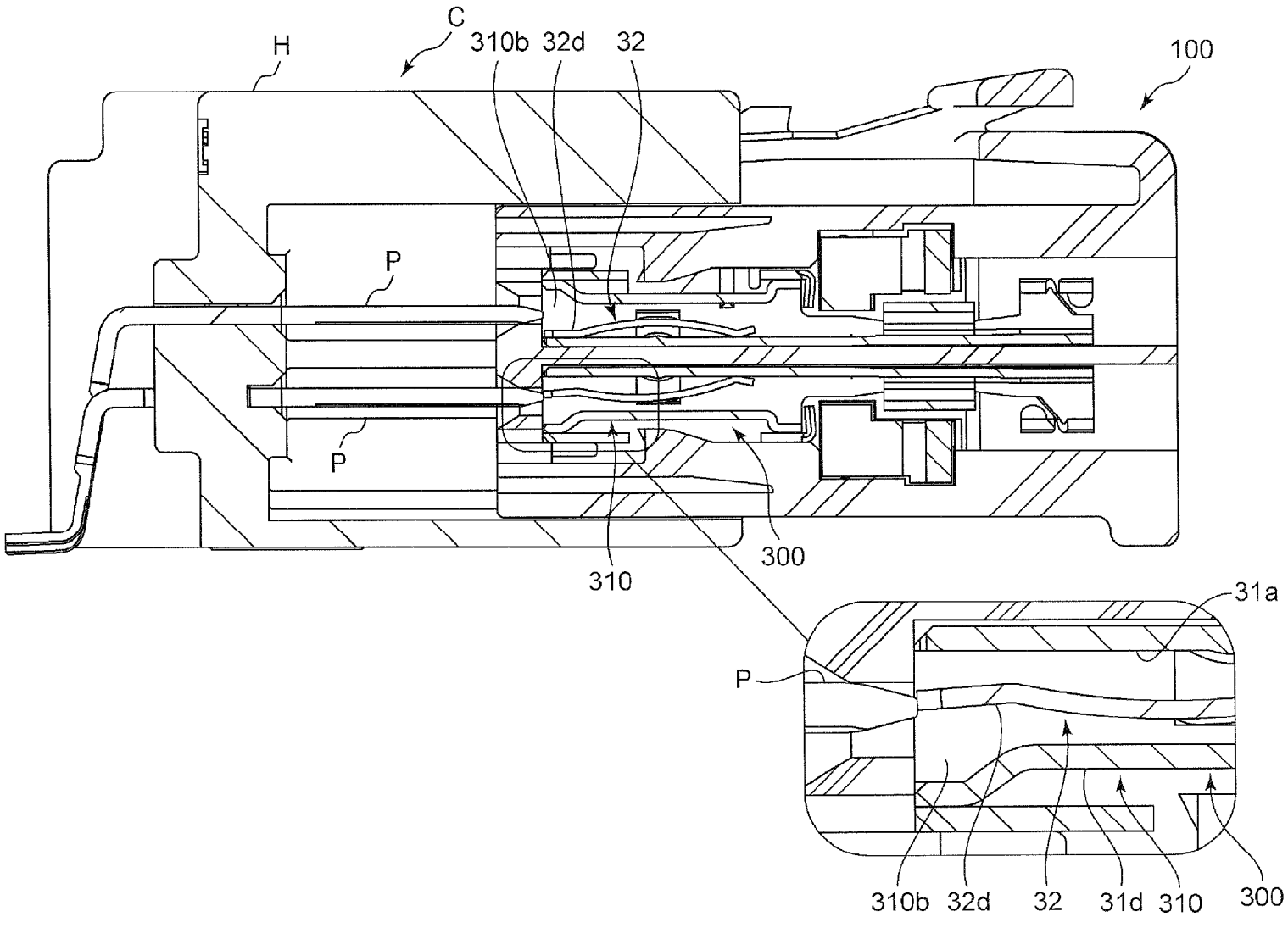
FIG. 9 is a cross-sectional view of a conventional female electric connector and a male electric connector, both being coupled to each other.

FIG. 9 is a cross-sectional view of a conventional electric connector 100 and the male connector C both coupled to each other.

When a user fits the male connector C into the conventional electric connector 100, as illustrated in FIG. 9, the elastic contact piece 32 may float up or nose down by its own weight at a distal end 32*d* thereof in the sheath portion 310 of the connector terminal 300. For instance, since the connector terminal 300 is located in a lower terminal space in the housing 20, the elastic contact piece 32 noses down at the distal end 32*d* thereof in FIG. 9. Since the distal end 32*d* of the elastic contact piece 32 is not restricted with respect to the displacement thereof, the distal end 32*d* noses down into a range of a cross-section of the insertion opening 21*c* through which the male terminal P is inserted into the housing 20, and thus, the distal end 32*d* is located to be seen through the insertion opening 21*c*. Accordingly, when the male terminal P is inserted into the housing 20 through the insertion opening 21*c*, the male terminal P makes abutment with the distal end 32*d*, and then, pushes the distal end 32*d* inwardly of the housing 20. As a result, it is afraid that the elastic contact piece 32 may be bent or damaged at the distal end 32*d* thereof.

Figure 10:
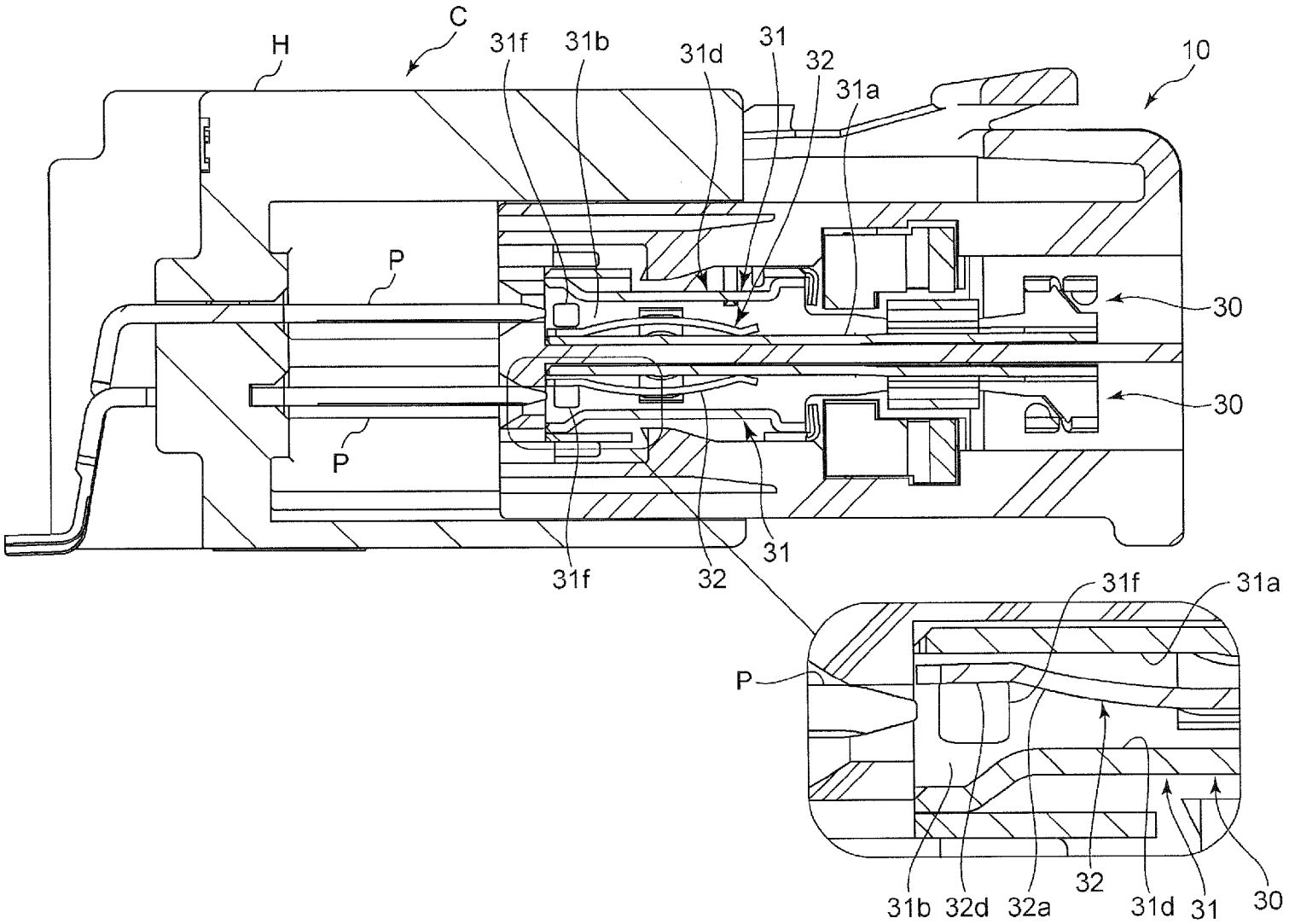
FIG. 10 is a cross-sectional view of the female electric connector illustrated in FIG. 1 and a male electric connector, both being coupled to each other.

FIG. 10 is a cross-sectional view of the electric connector 10 and the male connector C both coupled to each other.

Since the sheath portion 31 of the connector terminal 30 is formed at the inner walls 31*b*A and 31*c*A of the sidewalls 31*b* and 31*c* with the projections 31*f*, even if the elastic contact piece 32 floats up or noses down at the distal end 32*d* thereof into a range of a cross-section of the insertion opening 21*c*, the projections 31*f* make abutment with side edges 32*d*A (see FIG. 7) of the distal end 32*d* to thereby prevent the distal end 32*d* from entering the above-mentioned range. Thus, the distal end 32*d* of the elastic contact piece 32 does not interfere with the male terminal P, and hence, does not prevent the male terminal P from being inserted into the sheath portion 31.

Figure 11:
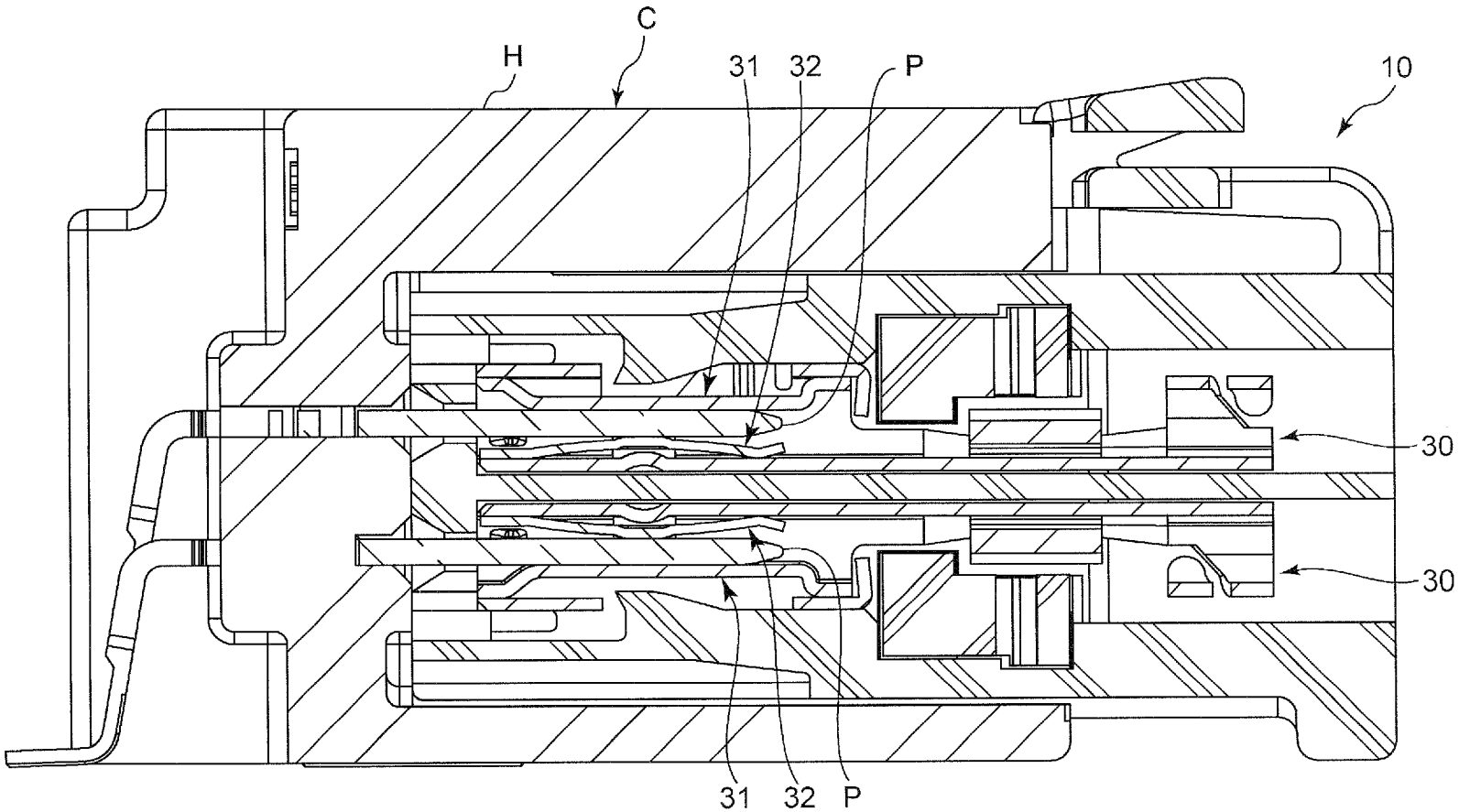
FIG. 11 is a cross-sectional view of the female electric connector illustrated in FIG. 1 and a male electric connector, both coupled to each other.

Consequently, as illustrated in FIG. 11, the male terminal P is able to be smoothly and fully inserted into the sheath portion 31 without being interfered with the elastic contact piece 32. Thus, the connector terminal 30 can provide highly reliable electrical connection with the male terminal P.

In the instant embodiment, as mentioned earlier, each of the insertion openings 21*c* includes the guide portion 21*d* having a smaller inner width at a location closer to the terminal space 21*a*, and the path 21*e* connecting therethrough the guide portion 21*d* and the terminal space 21*a* to each other.

Thus, the projections 31*f* restrict the distal end 32*d* of the elastic contact piece 32 such that the displacement of the distal end 32*d* is out of a cross-section of the path 21*e* having an inner width equal to the smallest inner width of the guide portion 21*d*.

Accordingly, the projections 31*f* prevent the distal end 32*d* of the elastic contact piece 32 from displacing towards a longitudinal axis of the sheath portion 31, resulting in that the distal end 32*d* is substantially in the level with an opening edge of the path 21*e*.

The guide portion 21*d* is designed to have a smaller inner width at a location closer to the terminal space 21*a*, and the path 21 is designed to have an inner width equal to the smallest inner width of the guide portion 21*d* and connect therethrough the guide portion 21*d* and the terminal space 21*a* to each other.

Thus, the sheath portion 31 may be designed to have a cross-section in accordance not with a largest cross-section of the insertion opening 21*c*, but with a smallest cross-section of the insertion opening 21*c*, that is, a cross-section of the path 21*e*. Consequently, the sheath portion 31 can be designed to have a small width and height, contributing to down-sizing of the connector terminal 30.

In the current embodiment, the projections 31*f* are formed by forming the recesses 31*g* on an outer surface of the sidewalls 31*b* and 31*c* of the sheath portion 31. Thus, it is not necessary to add a separate part as the projections 31*f* onto the sidewalls 31*b* and 31*c*. The projections 31*f* can be formed on the sidewalls 31*b* and 31*c* merely by pressing a metal sheet.

Figure 6:
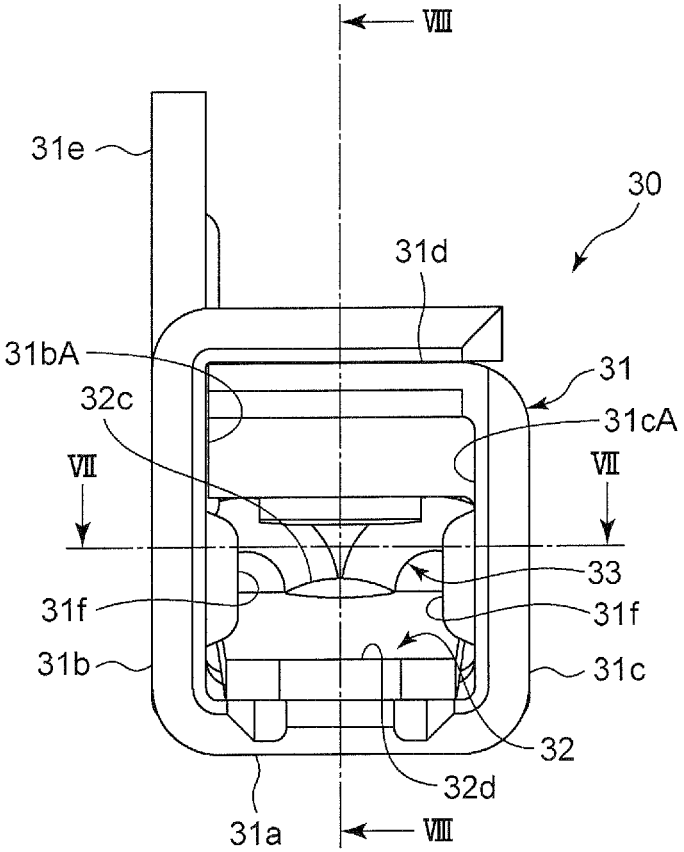
FIG. 6 is a front view of the connector terminal illustrated in FIG. 5.
Figure 7:
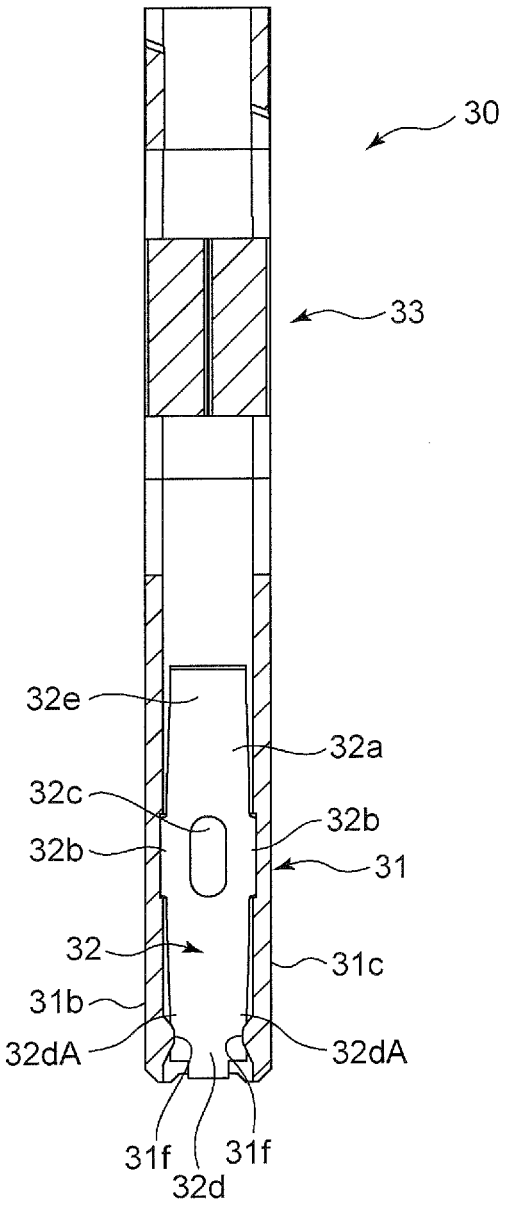
FIG. 7 is a cross-sectional view taken along the line VII-VII shown in FIG. 6.

As illustrated in FIG. 6, since the projections 31*f* are formed on the inner surfaces 31*b*A and 31*c*A of the sidewalls 31*b* and 31*c*, the projections 31*f* make uniform abutment with side edges of the distal end 32*d* of the elastic contact piece 32. Thus, the projections 31*f* prevent the elastic constant piece 32 from floating up and nosing down, ensuring that it is possible to prevent the elastic contact piece 32 from floating up or nosing down at one of the side edges 32*d*A thereof.

After having been inserted into the connector terminal 30, the male terminal P makes contact with the raised portion 32*c* (see FIG. 6) of the elastic contact piece 32.

Figure 12:
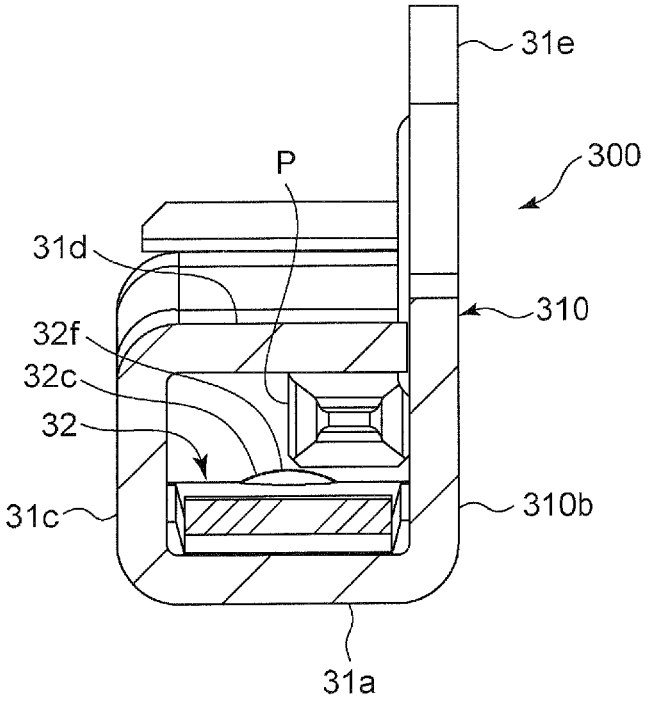
FIG. 12 is a cross-sectional view of a conventional connector terminal into which a male terminal is inserted, viewed from a rear of the conventional connector terminal.

For instance, as illustrated in FIG. 12, in the case that a sheath portion 310 of a connector terminal 300 is designed not to include the projections 31*f*, the male terminal P may be inserted into the sheath portion 310 out of a longitudinal axis of the sheath portion 310, and deviated towards one of sidewalls 310.

In such a condition, the male terminal P is positioned at a longitudinal axis thereof out of a summit 32*f* of the raised portion 32*c* of the elastic contact piece 32, resulting in poor stability in the male terminal P and reduction in an area through which the male terminal P and the elastic contact piece 32 make contact with each other. This may cause defectiveness in electrical connection between the male terminal P and the elastic contact piece 32.

Figure 13:
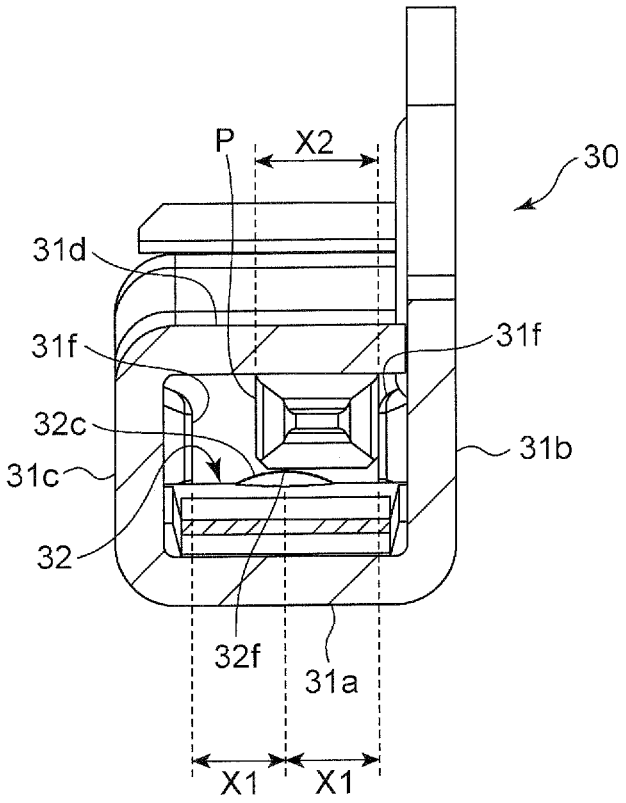
FIG. 13 is a cross-sectional view of the connector terminal illustrated in FIG. 5 into which a male terminal is inserted, viewed from a rear of the conventional connector terminal.

However, as illustrated in FIG. 13, since the distance X1 between the projection 31*f* and the summit 32*f* of the raised portion 32*c* is set smaller than the width X2 of the male terminal P in the connector terminal 30, even if the male terminal P is positioned at a longitudinal axis thereof out of the summit 32*f* of the raised portion 32*c*, and is inserted into the sheath portion 310 in a condition of being deviated towards one of side-walls 310, it is possible to ensure the male terminal P to make stable contact with the raised portion 32*c* of the elastic contact piece 32.

When the connector terminal 30 is released out of the housing 20, there is used a jig (not illustrated). The sheath portion 31 of the connector terminal 30 having been inserted into the terminal space 21*a* is engaged to the housing 20 by means of the stopper 21*j*. The jig releases the engagement of the sheath portion 31 with the stopper 21*j* to thereby allow the connector terminal 30 to be pulled out of the housing 20.

When the connector terminal 30 is pulled out of the housing 20 by means of the jig, the jig is inserted into the jig-insertion openings 21*f* (see FIGS. 1 and 3) formed at the front 21*b* of the housing 20.

If a user inserts the jig wrongly into the insertion opening 21*c* formed at the front 21*b* of the housing 20, though the user intends to insert the jig into the jig-insertion opening 21*f*, the elastic contact piece 32 may be damaged by the jig.

Figure 14:
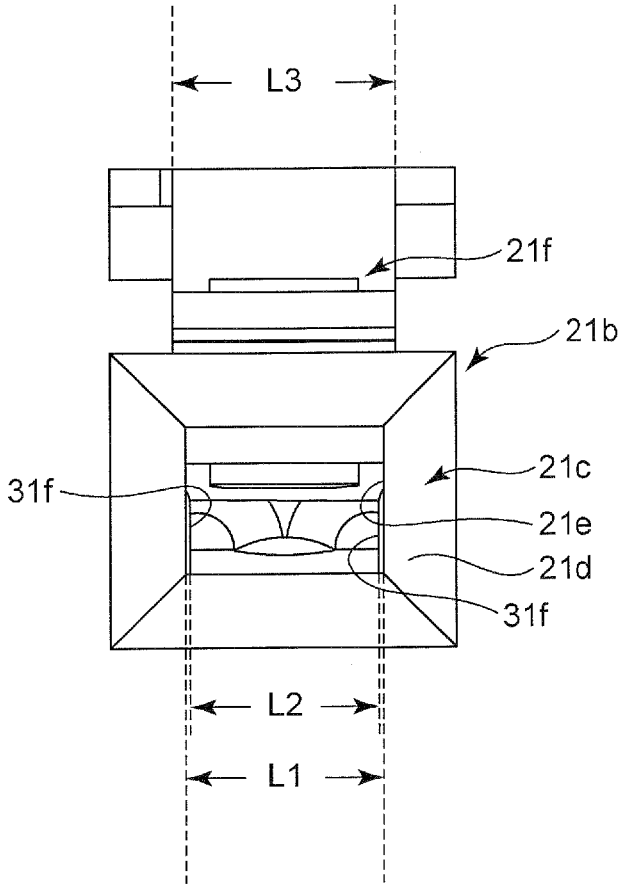
FIG. 14 is a front view of the sheath portion and an opening through which a jig is inserted into a connector housing.
Figure 15:
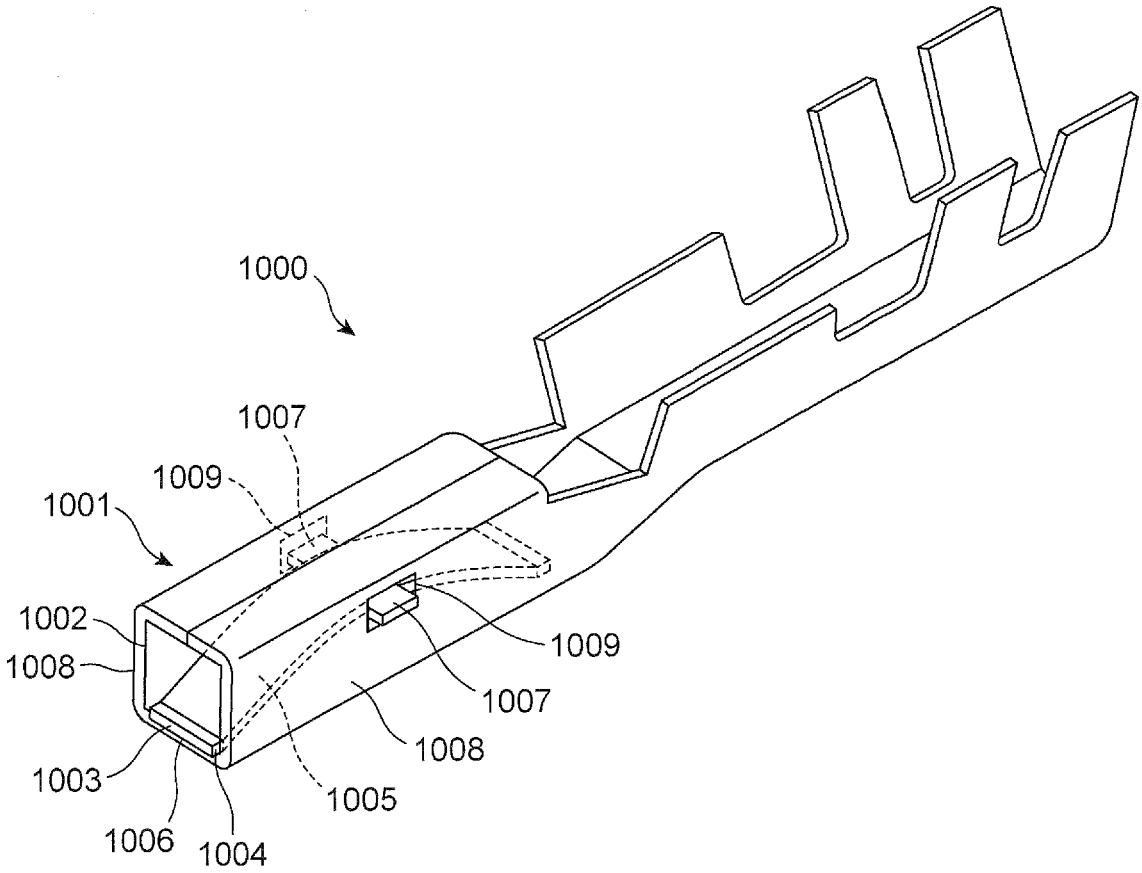
FIG. 15 is a perspective view of the first conventional connector terminal.
Figure 16:
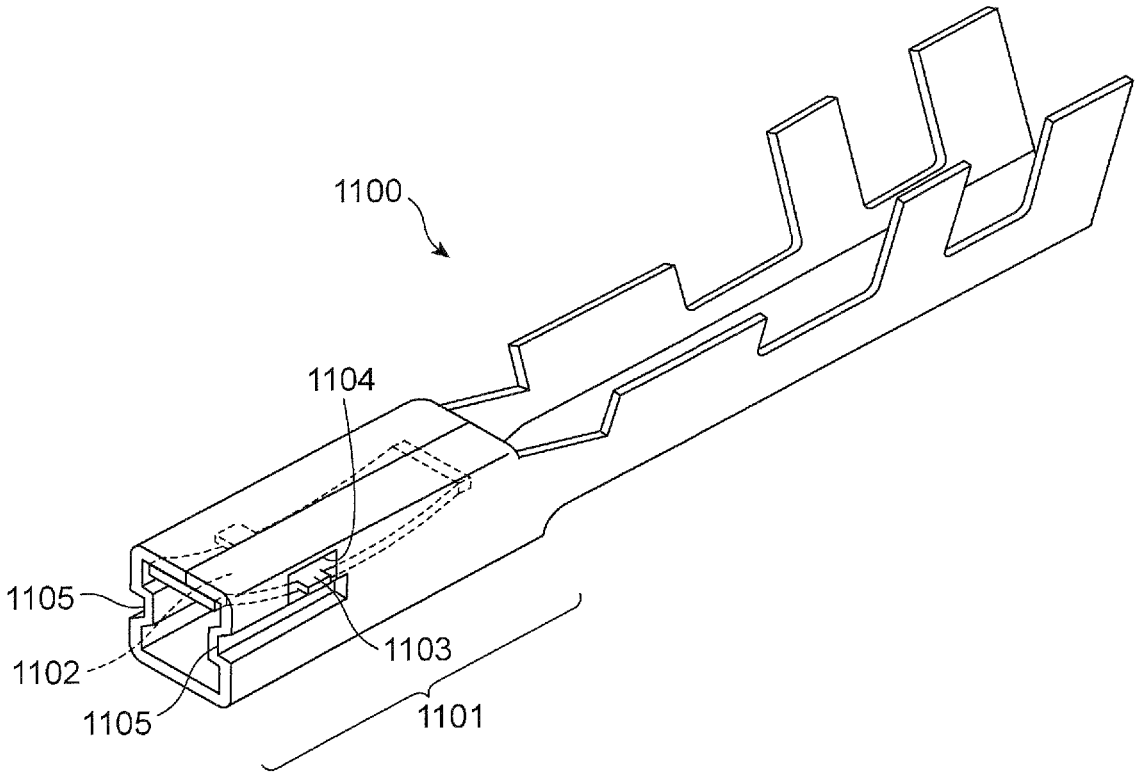
FIG. 16 is a perspective view of the second conventional connector terminal.

As illustrated in FIGS. 6 and 14, since the sheath portion 31 is formed at the inner surfaces 31*b*A and 31*c*A of the sidewalls 31*b* and 31*c* with the projections 31*f*, a distance L2 between the projections 31*f* facing each other is smaller than a distance L1 between the sidewalls 31*b* and 31*c* (herein, the distance L1 is equal to a width of the guide portion 21*d* at the rear end thereof or a width of the path 21*e*).

The jig has a width equal to a width L3 of the jig-insertion opening 21*f*.

Accordingly, even if a user attempts to insert the jig wrongly to the insertion opening 21*c*, the jig will make abutment with the projections 31*f* to thereby be prevented from further insertion.

Furthermore, if the jig has a width smaller than the width L1 of an opening of the sheath portion 31, but greater than the distance L2 between the projections 31*f*, the jig will make abutment with the projections 31*f* to thereby be prevented from further insertion.

Thus, it is possible to prevent the elastic contact piece 32 from being damaged by the wrong insertion of the jig into the insertion opening 21*c*.

The sheath portion 31 in the current embodiment is designed to include a pair of the projections 31*f* formed on the inner surfaces 31*b*A and 31*c*A of the sidewalls 31*b* and 31*c*. It should be noted that the sheath portion 31 may be designed to include one projection 31*f* on one of the inner surfaces 31*b*A and 31*c*A of the sidewalls 31*b* and 31*c*.

Figure 5:
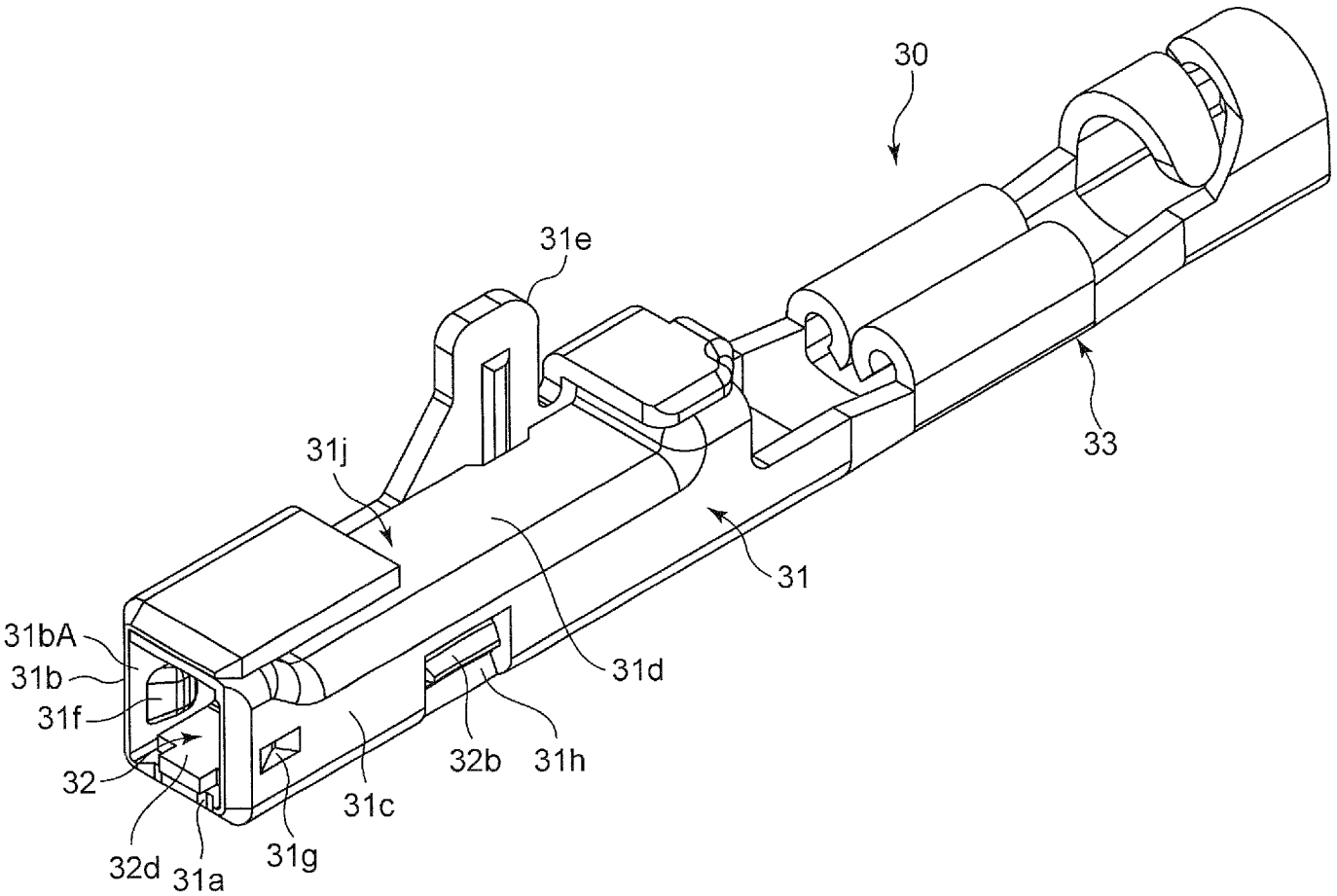
FIG. 5 is a perspective view of the connector terminal in accordance with the embodiment of the present invention.

As illustrated in FIGS. 5 and 10, each of the projections 31*f* in the current embodiment is square when viewed from a top thereof. It should be noted that a shape of the projection 31*f* is not to be limited to a square.

INDUSTRIAL APPLICABILITY

The connector terminal in accordance with the present invention is suitable, as a connector for connecting wires to each other through which electric signals are transmitted, to an electric connector used broadly in fields such as an automobile industry, an electric/electronic device industry and various mechanical industries.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2014-021522 filed on Feb. 6, 2014 including specification, claims, drawings and summary is incorporated herein by reference in its entirety.

What is claimed is:

1. A connector terminal including:

a hollow sheath portion to be inserted into a terminal space formed in a housing of an electric connector; and an elastic contact piece positioned in said sheath portion, said contact piece making mechanical and electrical contact with a male terminal of an opponent electric connector when said male terminal is inserted into said sheath portion, said male terminal being inserted into said sheath portion through an insertion path formed in said housing, said sheath portion being formed with a projection on at least one of inner walls thereof facing each other, the projection inducing a distal end of said contact piece to be located out of a cross-section of said insertion path in a direction perpendicular to a direction in which said male terminal is inserted into said sheath portion.

2. The connector terminal as set forth in claim 1, wherein said projection is formed by forming a recess on an outer surface of a sidewall of said sheath portion.

3. The connector terminal as set forth in claim 1, wherein said projection is formed on both of said inner walls of said sheath portion.

4. The connector terminal as set forth in claim 1, wherein said contact piece is formed with a raised portion at which said contact piece makes contact with said male terminal, a distance between said projection and a summit of said raised portion being smaller than a width of said male terminal.

5. The connector terminal as set forth in claim 3, wherein a distance between said projections is smaller than a width of an opening through which a jig is inserted into said housing for releasing said sheath portion having been engaged to an engagement portion in said terminal space.

6. The connector terminal as set forth in claim 1, wherein a distance between said projection and said inner wall facing said projection is smaller than a width of an opening through which a jig is inserted into said housing for releasing said sheath portion having been engaged to an engagement portion in said terminal space.

7. The connector terminal as set forth in claim 1, wherein said sheath portion has an opening greater in four directions than said insertion path when said connector terminal is inserted into said housing.

* * * * *